United States Patent [19]

Henne

[11] Patent Number: 4,838,586

[45] Date of Patent: Jun. 13, 1989

[54] OVEN DOOR WITH MEANS FOR PREVENTING INADVERTENT LOCKING

[75] Inventor: John R. Henne, Burlington, Conn.

[73] Assignee: The Stanley Works, New Britain, Conn.

[21] Appl. No.: 99,491

[22] Filed: Sep. 22, 1987

[51] Int. Cl.[4] ..... E05C 5/02

[52] U.S. Cl. ..... 292/113; 292/DIG. 69

[58] Field of Search ..... 292/113, 210, 108, 196, 292/DIG. 69, DIG. 66

[56] References Cited

U.S. PATENT DOCUMENTS

| | | | |
|---|---|---|---|
| 3,325,200 | 6/1967 | Fowler | 292/113 |
| 3,406,677 | 10/1968 | Anderson | 126/197 |
| 3,438,666 | 4/1969 | Erickson | 292/DIG. 69 X |
| 3,540,667 | 11/1970 | Siegel | 292/210 |
| 4,133,337 | 1/1979 | Shea | 292/113 |
| 4,163,443 | 8/1979 | Peterson | 292/216 |
| 4,174,860 | 11/1979 | Shea | 292/113 |
| 4,364,589 | 12/1982 | Watson | 292/113 |
| 4,554,907 | 11/1985 | Overley et al. | 292/27 |
| 4,593,945 | 6/1986 | Arute et al. | 292/DIG. 69 X |

*Primary Examiner*—Richard E. Moore

[57] ABSTRACT

A latch for oven doors and the like includes a support, and a latch assembly movable on the support between latching and unlatching positions having a handle, a latching arm and a projecting arm. The handle is operative to move the latch arm between latching and unlatching positions. Also included are a locking pawl having an abutment thereon engagable by the projecting arm to block its movement from latching to unlatching position, a thermal element operatively connected to the locking pawl and responsive to elevated temperatures to move the pawl from a first position wherein the abutment is removed from the path of movement of the projecting arm from latching position to unlatching posiiton and to a second position wherein the abutment is disposed in the path of movement of the projecting arm to block its movement into unlatching position. The thermal element is being responsive to a subsequent decline in temperature to move the pawl from the second position to the first position, and the projecting arm is configured to contact the abutment in its second position so that the arm cannot be moved past the abutment from its unlatched position.

3 Claims, 3 Drawing Sheets

OVEN DOOR WITH MEANS FOR PREVENTING INADVERTENT LOCKING

FIELD OF THE INVENTION

This invention relates to latches for pyrolytic ovens and like devices wherein it is desirable to latch the door during high temperature or other cycles in which access to the interior might be injurious.

BACKGROUND OF THE INVENTION

Pyrolytic ovens are in common usage today and the self-cleaning feature thereof requires that the oven door be safely latched while the oven is at extemely high temperatures during a so-caled self-cleaning period, and that the latch remain unreleasable until the oven has cooled to a predetermined temperature.

In some pyrolytic or self-cleaning ovens, a bimetallic coil, which is responsive to the temperature in the oven, moves a pawl or dog into a blocking position with respect to a latch to thereby prevent the latch from moving from a latched position to an unlatched position after the bimetallic strip senses temperatures above a predetermined level. Such a device is disclosed in U.S. Pat. Nos. 3,438,666 and 4,133,337.

The bimetallic coil is, of course, sensitive to the heat in the oven, whether it is in a self-cleaning mode or in any heating mode, and will move the blocking pawl towards a blocking position. It is also possible to lock it inadavertently during an extended bake cycle. If the user of the oven places the oven in a bake mode at an elevated temperature for an extended period of time, the locking dog may move to a position which would block the movement of the handle from the latched position to the unlatched position.

A problem is presented by the possibility that, during an extended baking cycle, a child, or perhaps other person, may inadavertently move the latching handle to a latched position. This may be possible because the latch may be cammed past the locking pawl and then the latch will be blocked from unlatching by the locking pawl until the oven temperature falls to a level such that the bimetallic element will move the locking pawl away from a blocking position. This can have deleterious effects on the contents of the oven which are being subjected to baking, in that the oven door cannot be opened at a desired time, and the contents of the oven will continue to bake, perhaps resulting in a burned condition or in any event, an overcooked condition.

Accordingly, it is an object of the present invention to provide a new latching and blocking mechanism such that the latch cannot be moved to the latched position from an unlatched position if the locking dog under the control of the bimetallic element has moved to a position in which the locking dog would lock the latch if the latch is not inadvertently set.

A specific object of this invention is to provide an improved latch for pyrolytic ovens and the like which prevents inadvertent latching of the oven door when it is not in a self-cleaning mode.

SUMMARY OF THE INVENTION

In the present invention, a bimetallic strip formed in a coil senses the temperature of an oven and moves a dog or abutment on a pawl to a position in which an especially formed latch cannot cam past the locking dog when the locking dog has moved to a locking position.

This prevents inadvertent latching and retention of the latch by the thermal element.

Briefly stated, the invention comprises a support member with a latch assembly movable thereon between latching and unlatching positions, the assembly includes a handle and a projecting arm, the handle being operative to move the projecting arm between latching and unlatching positions. A high temperature responsive locking pawl has an abutment or dog thereon engageable with the projecting arm to block its movement from latching to unlatching position. A thermal element operatively connected to the locking pawl and responsive to elevated temperatures to move the pawl from a first position wherein the abutment is removed from the path of movement of the projecting arm from latching position to unlatching position and to a second position where the abutment is disposed in the path of movement of the projecting arm to block its movement into unlatching position. The thermal element is responsive to a subsequent decline in temperature to move the pawl from the second position to the first position; and the projecting arm is configured to contact the abutment in its second position so that the arm cannot be moved past the abutment.

DETAILED DESCRIPTION OF THE PREFERRED EMBODIMENT OF THE INVENTION

Figure 1:
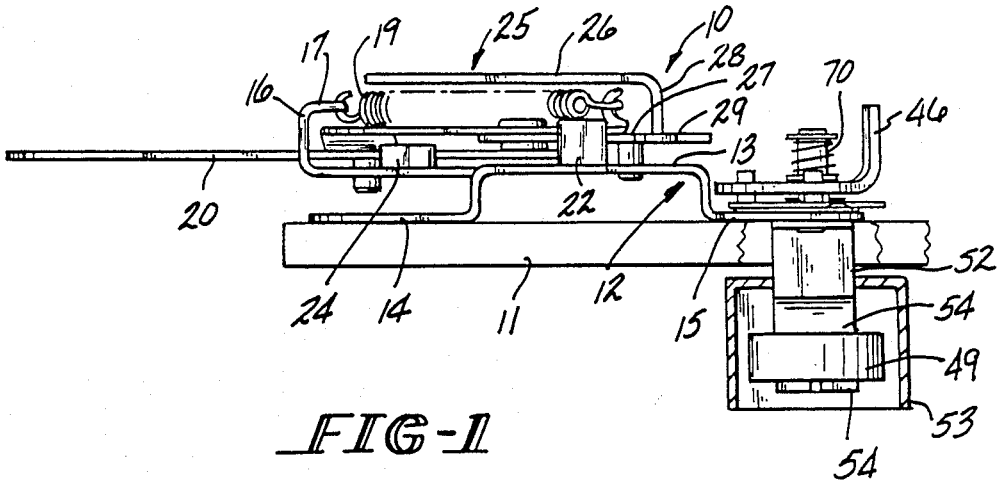
FIG. 1 is a side elevational view of an oven latch assembly embodying the invention with the handle removed, a portion shown in half section, and with a portion of the oven housing being fragmentarily illustrated.
Figure 2:
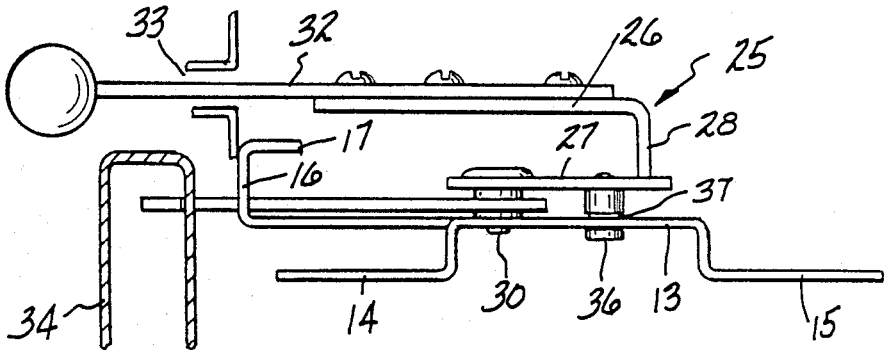
FIG. 2 is an enlarged side elevational view similar to FIG. 1, but with some parts removed and with the operating handle attached.
Figure 5:
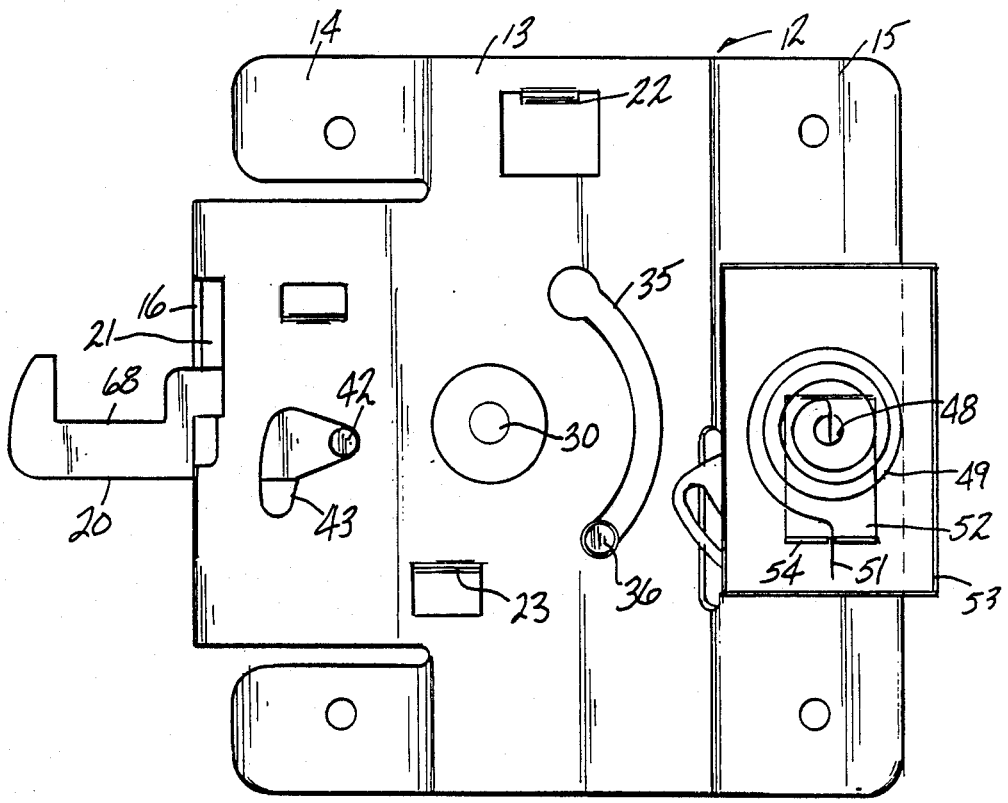
FIG. 5 is a view of the underside of the mechanism of FIG. 3.
Figure 6:
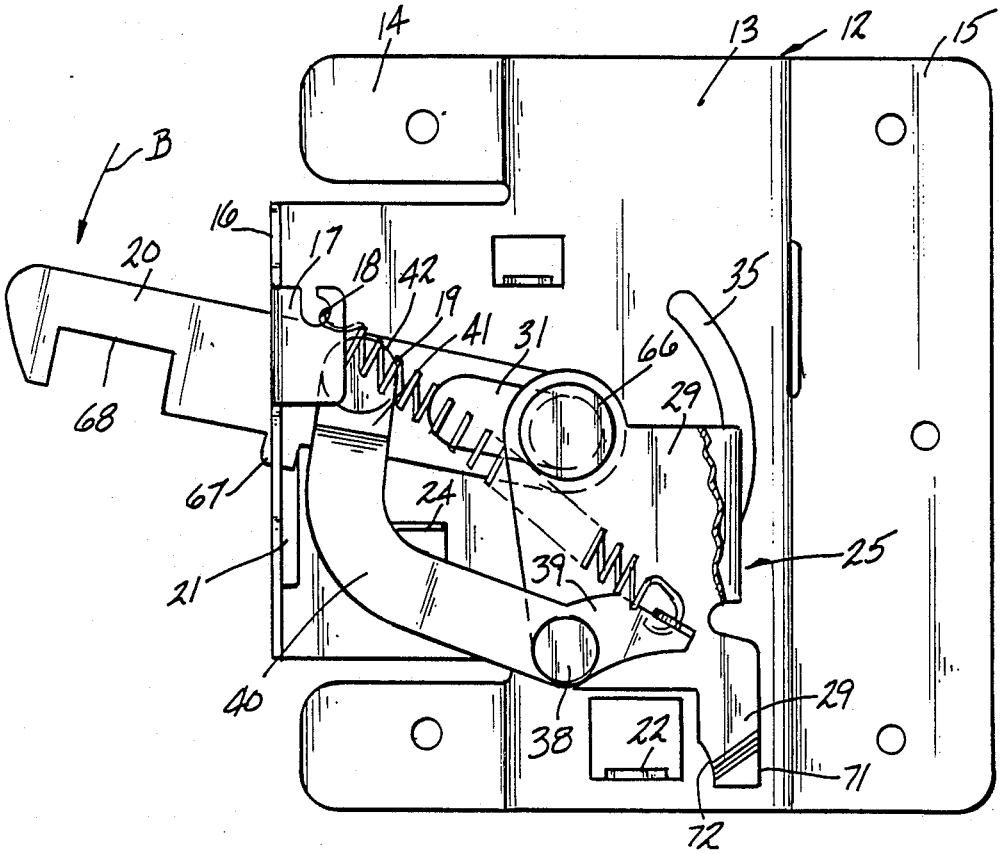
FIG. 6 is a view similar to FIG. 3, but with the latch in an unlatched position and with parts removed for clarity of illustration.

Referring now to FIGS. 1 and 2, a latching mechanism 10 embodying the invention is mounted to a fragmentally illustrated horizontal wall 11 of the appliance. As is customary, the wall 11 is spaced above the oven cavity (not shown). The latching mechanism comprises a support plate 12 which is secured to wall 11 by a plurality of fasteners (not shown). Support plate 12 is stamped or otherwise formed to provide an elevated platform portion 13 essentially parallel to an spaced from wall 11. At each end are depending L-shaped flanges 14 and 15. On the latch side of the mechanism, is an upstanding wall 16 with a finger 17 which provides an anchor 18 (not shown in FIG. 1) for one end of a spring 19. A latch arm 20 extends through an elongated slot 21 in wall 16 (FIGS. 5 and 6). The platform portion 12 is staked upwardly to provide upstanding abutments 22, 23, and 24 (FIG. 6) to limit movements of parts as hereinafter described. Disposed upon platform 12, is a bracket 25 of generally U-shape construction, with an upper wall 26, a lower wall 27, and an interconnecting wall 28. The bottom wall includes an integral projecting arm 29. The bottom wall is pivotally mounted to platform 13 by a pin 30 which is staked to platform 13 and extends through an elongated slot 31 in latch arm 20 (FIG. 6).

As shown in FIG. 2, an operating handle 32 is attached to upper member 26 of bracket 25 and extends through an opening 33 in the front of the appliance. The latching arm 20 is shown in a latched position engaging door 34 of the appliance.

Figure 3:
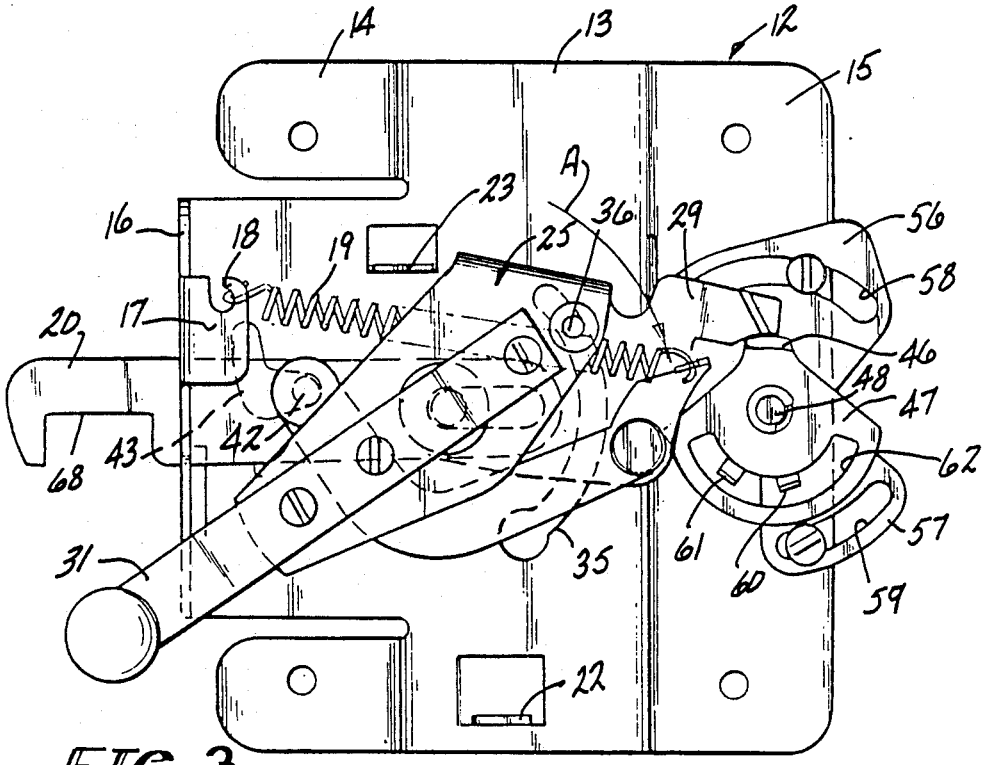
FIG. 3 is a top plan view of the mechanism of FIG. 1 showing the latch in a latched position and blocked from opening.

Reference is now made to FIG. 3 in conjunction with FIG. 2. Defined in platform 13 is an arcuate slot 35 which receives a pin 36 which is recessed intermediate the ends, as exemplified by the reference numeral 37 so that it overlies the edges defining slot 35 and prevents any rocking motion of member 25 and handle 31.

Pivotally connected to lower member 27 of bracket 25 by a pin 38 is one end 39 of a toggle arm 40 (FIG. 6). The other end 41 of toggle arm 40 is pivotally connected to latch arm 20 by a pin 42 which extends into a cam slot 43 (FIG. 5). Spring 19 has its other end connected to an upstanding end 44 on toggle arm 40.

As shown in FIGS. 2 and 3, latch arm 20 is in a latching position and blocked from unlatching. As will be noted in FIG. 3, extension 29 of member 25 is engaged by a dog 46 of a blocking pawl 47 which is mounted on a rotatable shaft 48. A coiled bimetallic strip 49 (FIGS. 1 and 5) has its inner end 50 secured to shaft 48 and its outer end 51 to a bracket 52. A housing member 53 with a lower opening surrounds strip 49. Shaft 48 extends through flange 15 of support plate 14 to the bimetallic element 49. Bracket 52 is of L-shape with a further depending flange 54, and is secured to flange 15 of support member 12. Adjustably mounted to flange 15 are adjustment members 56 and 57 having arcuate slots 58 and 59, respectively. Adjustment member 58 carries an upstanding stop 60 and adjustment member 57 carries an upstanding stop 61. These stops extend into an arcuate slot 62 defined in pawl 47, and the member 56 and 57 are adjustable to determine the limits of rotation of pawl 47 on shaft 48. The adjustment members 56 and 57 are pivotal about shaft 48.

FIG. 3 illustrates the latch in a latched and blocked position during a self-cleaning operation of the oven, where the dog 46 on pawl 47 blocks the arm 29 and prevents the mechanism from being unlatched. As shown in FIG. 3, member 25 has not moved to its fully latched position, at which point lower plate 27 would engage finger 23, but is shown in a position where attempt is being made to unlatch, as indicated by the arrow A.

FIG. 5 is a view of the latching mechanism in a latched position, as seen from the underside thereof, and corresponds to the condition shown in FIG. 3.

Figure 4:
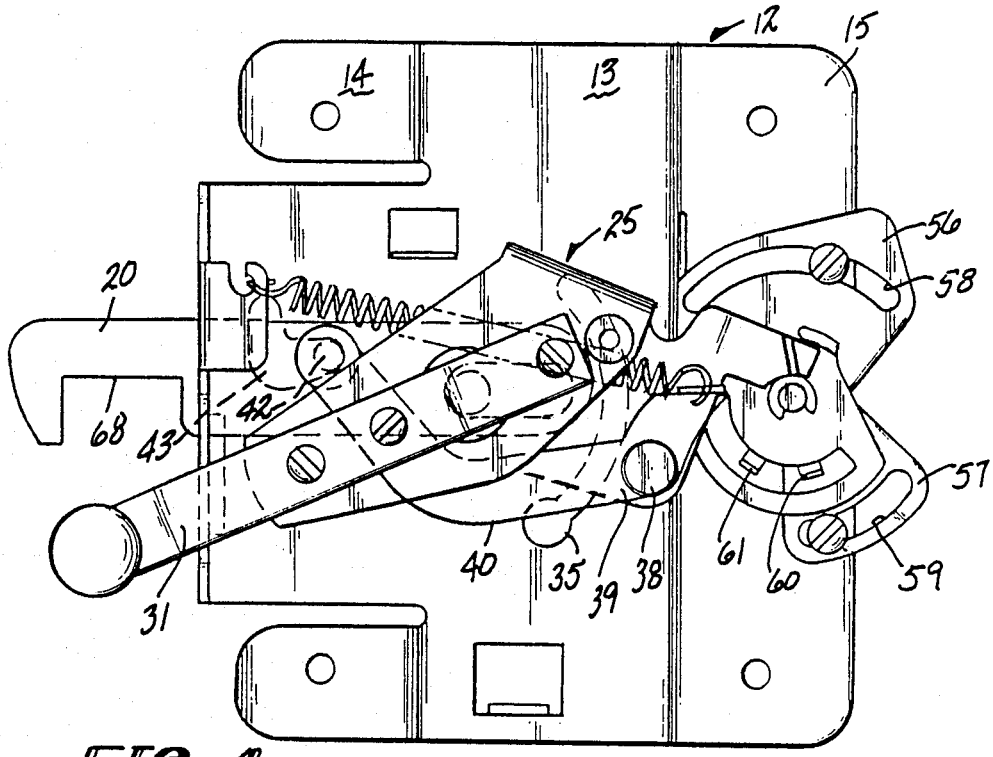
FIG. 4 is a view similar to FIG. 3, but showing the locking dog in a position which prevents blocking of the latch mechanism by the heat responsive pawl when not in a self-cleaning mode.

FIG. 4 is identical to FIG. 3, with the exception that the dog 46 on pawl 47 is in a position which prevents movement of arm 29 to a position where it could be blocked in a latched position by dog 46. This is the condition where the oven has been in a baking mode at an elevated temperature for some time, and pawl 47 with dog 46 thereon has moved to a position which prevents inadvertent blocking of the arm 29 in a latched position, as exemplified in FIG. 3. Latch arm 20 is in a latching position in FIG. 4, but is not blocked from opening by dog 46 as is the case in FIG. 3.

Stop 24 will engage a finger 67 on latch arm 20 and prevent inward movement of latch arm 20 on backing 66 if latch arm does not engage the door 34.

Reference is now made to FIG. 6, which shows the mechanism with portions thereof removed in a top plan view when the mechanism is in an unlatched position. Latch arm 20 has an elongated slot 31 which receives therein a bushing 66 on pin 30. It will further be noted that spring 19 is in a different position than shown in FIG. 3. As shown in FIG. 5, pin 42 on toggle arm 40 is in the latched condition, and in the unlatched condition of FIG. 6, pin 42 will be positioned as shown in dotted line in FIG. 5 within cam slot 43. When it is desired to latch the oven door, the latch 20 through the handle 31 and member 25 will be rotated in the direction of the arrow B in FIG. 6. When the cut-out 68 in latching arm 20 engages a strike plate on the oven door (not shown) motion of the latch arm will be halted. Further rotation of handle 31 will then cause latch arm 20 to move on bushing 66 in elongated slot 31 inwardly and the latch 20 will pull the oven door in tightly to close the opening to the oven. As this occurs, spring 19 moves past pin 30 to the position shown in FIG. 3, over center toggle action occurs and the latching mechanism moves to a stable position.

The pawl 47 may rotate with respect to shaft 48. This might occur if the bimetallic strip rotates shaft 48 until the pawl strikes one of the stops 60 or 61 and the bimetallic coil continues to expand or contract. To accommodate such movement, pawl 47 is connected to shaft 48 by means of a clutch spring 70 (FIG. 1). The spring has sufficient tension so that shaft 48 may drive pawl 47 but will permit slippage therebetween if the pawl moves to one of its limits determined by the stops 60 and 61.

The configuration of the projecting arm 29, as most clearly shown in FIG. 6, is such that the leading edge 71 (when moving toward a latching position) will be blocked by dog 46 if the oven has been operated at high baking temperatures for a period of time and pawl 47 has been moved to the position shown in FIG. 4. In this position, spring 19 has moved over center and the door is latched. However, arm 29 is not blocked from opening by dog 46 at the end of a bake cycle, and the latch may be readily unlatched when desired.

Both the trailing edge 72 of arm 29 and the outer surface of arm 29 are arcutely shaped so that the arm 29 will have blocking contact with dog 46 when the oven is in the self-cleaning mode as shown in FIG. 3. The latch may not be unlatched until the bi-metallic coil moves pawl 47 and dog 46 to a position where arm 29 may clear dog 46.

Thus, it may be seen that the object of the invention set forth, as well as those made apparent from the foregoing description, are efficiently attained. Although a preferred embodiment of the invention has been set forth for purposes of disclosure, modifications to the disclosed embodiment of the invention, as well as other embodiments thereof, may occur to those skilled in the art. Accordingly, the appended claims are intended to covrer all embodiments of the invention and modifications to the disclosed embodiments which do not depart from the spirit and scope of the invention.

Having thus described the invention, what is claimed is:

1. A latch for oven doors and the like comprising:
a support;
a latch assembly movable on said support between latching an unlatching positions, said assembly including a handle, a latch arm and a projecting arm, said handle being operative to move said latch arm between latching and unlatching positions and simultaneously to move said projecting arm:

a locking pawl having an abutment thereon engagable with said projecting arm to block its movement from latching to unlatching position; and a thermal element operatively connected to said locking pawl and responsive to elevated temperatures to move said pawl from a first position wherein said abutment is removed from the path of movement of said projecting arm from its latching position to its unlatching position and moved to a second position wherein said abutment is disposed in said path of movement of said projecting arm to block its movement into its unlatching position, said thermal element being responsive to a subsequent decline in temperature to move said pawl from said second position to said first position, said projecting arm being configured to contact said abutment in said second position so that said projecting arm cannot be moved past said abutment, said projecting arm having leading and trailing edges configured to engage and be blocked by said abutment when said abutment is in said second position.

2. The latch of claim 1 wherein said locking pawl is rotatable by said thermal element and said abutment has an arcuate outer surface, said projecting arm having an arcuate trailing edge which is adapted to engage said outer surface of said abutment when said pawl is in said second position.

3. The latch of claim 1 wherein said locking pawl is rotatable by said thermal element and said projecting arm has a leading edge which will engage the inner surface of said abutment if said pawl is in said second position and attempt is made to move said latch arm to a latching position.

* * * * *